US006527125B2

(12) United States Patent
Niitti

(10) Patent No.: US 6,527,125 B2
(45) Date of Patent: Mar. 4, 2003

(54) WASHING LIQUID DISTRIBUTION SYSTEM

(75) Inventor: Timo U. Niitti, Ponte Vedra, FL (US)

(73) Assignee: Outokumpu Oyj (FI)

( * ) Notice: Subject to any disclaimer, the term of this patent is extended or adjusted under 35 U.S.C. 154(b) by 0 days.

(21) Appl. No.: 09/880,949

(22) Filed: Jun. 15, 2001

(65) Prior Publication Data

US 2002/0189979 A1 Dec. 19, 2002

(51) Int. Cl.[7] ..... B03B 11/00; F17D 1/13

(52) U.S. Cl. ..... 209/498; 209/434; 209/459; 209/906; 209/488; 137/625.15

(58) Field of Search ..... 209/498, 157, 209/365.2, 434, 459, 488, 497, 499, 504, 505, 906; 210/767, 97, 101, 512.1, 512.2; 222/64, 71, 163, 164, 166–172, 464.1, 478; 137/625.15

(56) References Cited

U.S. PATENT DOCUMENTS

| | | | | | |
|---|---|---|---|---|---|
| 2,700,469 | A | * | 1/1955 | Humphreys | 209/459 |
| 2,985,589 | A | * | 5/1961 | Broughton et al. | 208/310 R |
| 3,568,832 | A | * | 3/1971 | Persson | 209/459 |
| 3,849,232 | A | * | 11/1974 | Kessler et al. | 159/13.2 |
| 4,567,942 | A | * | 2/1986 | Stafford et al. | 165/115 |
| 4,839,108 | A | * | 6/1989 | Silvey | 196/100 |
| 5,472,096 | A | * | 12/1995 | Prinsloo | 209/459 |
| 5,680,989 | A | * | 10/1997 | Plachy et al. | 137/561 A |
| 6,216,733 | B1 | * | 4/2001 | Sondov | 137/561 A |

FOREIGN PATENT DOCUMENTS

| | | | | | |
|---|---|---|---|---|---|
| GB | 2193121 | A | * | 2/1988 | B03B/5/62 |
| JP | 3-223576 | A | * | 10/1991 | F16K/7/06 |

* cited by examiner

*Primary Examiner*—Donald P. Walsh
*Assistant Examiner*—Mark J. Beauchaine
(74) *Attorney, Agent, or Firm*—Arthur G. Yeager

(57) ABSTRACT

A system for delivering the same or differing controllable amounts of washing liquid to several flights of a spiral separator including a housing, a plurality of spaced members having a respective generally vertical passage communicating with fluid in the housing and permitting fluid to flow therethrough. A plurality of fluid passageways respectively communicate with the members to provide the same or differing amounts of liquid to each of the flights. The distributor housing may include a central liquid receiving chamber, a plurality of spaced compartments located in proximity with the chamber, a plurality of passages through-which fluid flows into fluid passageways respectively coupled to the compartments, a single flow controller rotatable therein to expose different portions of said passages at every rotation thereby varying the liquid flow to each compartment. The housing may be tilted to vary the amount of liquid flowing into each of the compartments, thereby delivering the same or differing amounts of liquid to each of the flights enabling adjustment of the liquid flow for each flight. Another distributor housing contains a plurality of fluid passageways fluidly communicating with the plurality of flights of spiral separator, each of the fluid passageways having respectively a vertical passage for receiving liquid from the housing into the fluid passageways, and a tilting mechanism for tilting the housing to vary liquid flow through the passages.

25 Claims, 9 Drawing Sheets

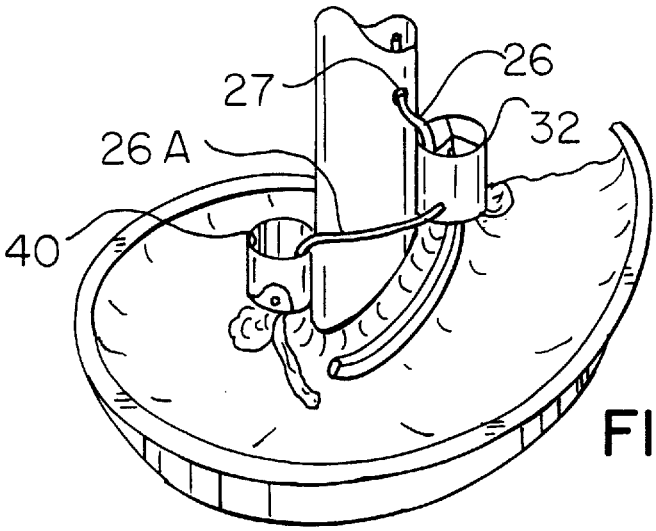
FIG. 5
FIG. 4
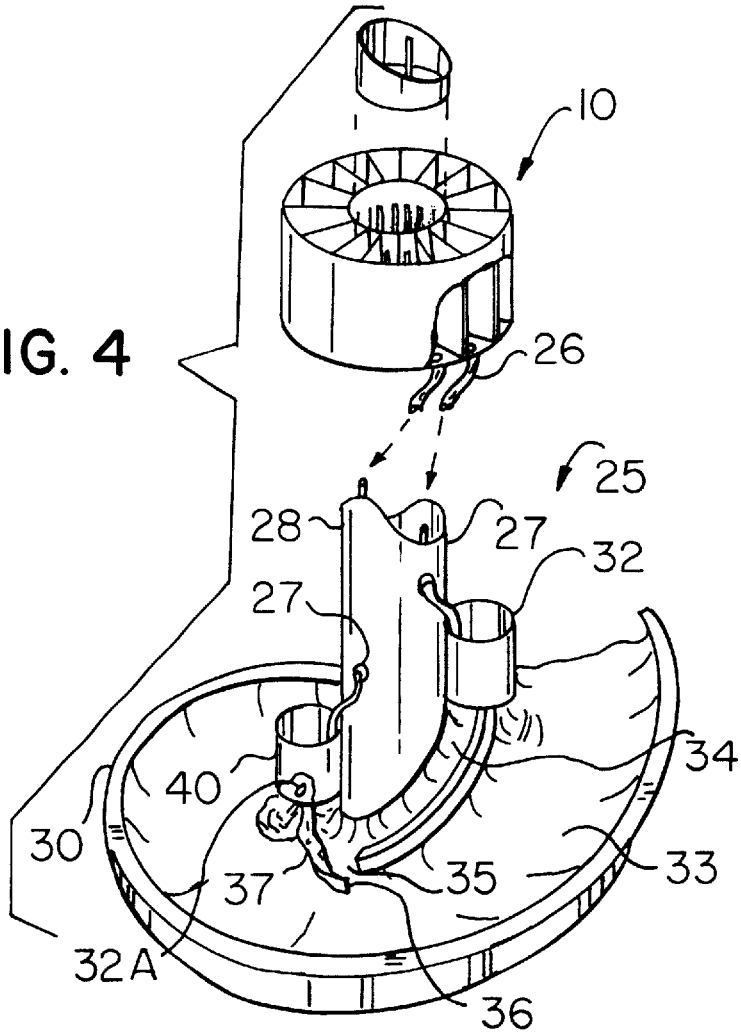

WASHING LIQUID DISTRIBUTION SYSTEM

CROSS REFERENCE TO RELATED APPLICATION

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to a liquid distribution system for a plurality of surfaces using an adjustable liquid flow distributor. A preferred application for the present invention is the spiral separators industry.

2. Related Art

Washing liquid distribution systems are used in different industrial processes such as separating concentrating particles in slurry from lighter ones in a spiral separator. The use of water or liquid washing has been found to be desirable because it will keep lighter particles washed off of the concentrating particles and will also assist in moving the heavier concentrates to their points of discharge in the spiral. The movement of the concentrating particles without washing water would be quite slow or may even stop completely because they are in not only the slowest moving zone but are in a very shallow or narrow portion of the slurry.

In the prior art, washing water or liquid is delivered through a spiraling pipe or launder trough. Typically, a spiral separator contains a water-carrying pipe with openings or a water channel that is adjacent to inner side of a trough surface in a spiral separator. A multitude of control valves control water flow from the pipe or water channel to the process trough. In a seven flights spiral separator, for example, a water carrying pipe may have seven to twenty openings and usually there is a control valve for each outlet.

Another prior art system has a center column, which is used as a water reservoir, and individual valves control the amount of water supplied to each point of addition along the spiral. The pressure difference between the points of addition makes it difficult to control the flow. Additionally, the kinetic energy of water at the lowest point of addition due to the high pressure might be large enough to disturb the liquid flow around the last point of addition.

The prior art discloses a variety of washing liquid delivery pipes in a spiral separator. For example, U.S. Pat. No. 2,700,469 discloses a washing water delivery pipe for a spiral separator. A washing water carrying channel is attached to an inner side of a trough of a flight. An open pipe links the water channel to the inner side transferring water there between. Another piping arrangement is disclosed in U.S. Pat. No. 2,431,560. A washing water carrying channel is disposed adjacent an inner side of a trough. A conduit disposed in the water channel and supported upon an adjustable bracket therein diverts washing water from the water channel to the inner side of the process trough. The inlet of the conduit faces the water moving stream within the channel, while the outlet of the conduit faces the inner side. Liquid is caused to enter the inlet of the conduit and is discharged through the outlet into the inner side. Another delivery pipe is disclosed in U.S. Pat. No. 2,431,559. A conduit is disposed transversing the trough so that the inlet of the conduit faces the upper and outer side of the trough and the outlet faces the inner and lower side. Water is caused to enter the inlet of the conduit and is discharged through the outlet to the inner and lower side of the process trough.

However, those washing water piping delivery systems suffer from several problems. On occasions, the amount of washing water in a particular trough surface in a flight needs to be adjusted. For example, when heavy concentrating particles composes a big proportion of a slurry, the thin film of liquid flowing adjacent the inner side of a flight may not be sufficient to transport the heavy particles down the spiral. In order to add water to the thin liquid film, one needs to adjust the water control valves. For example, adjusting one valve to increase the flow often decreases the flow to all other outlets. The decrease of water amount volume through one outlet is not proportional to that in another outlet. The decrease in flow in the other outlets may not be desirable. To avoid such problem, an operator even has to adjust all the valves in the spiral separator.

Furthermore, the problem is worsen if the process includes several hundred separators each having several flights as is the case normally. Adjusting all the valves in all these separators consumes significant time and energy and becomes practically an impossible task Additionally, the control valves may become blocked because the they are sensitive to impurities in the water since the size of these control valves is very small.

Because of these and other problems in the prior art, it is apparent that there is a need for a water distribution system that enables control of amount of water flowing in a plurality of flights in several separators.

It is an object of the present invention to provide a washing liquid distribution system that enables manipulating the amount of liquid flowing into each flight of a single spiral separator.

It is another object of the invention is to provide for a liquid distribution system that enables easy and quick adjustment of water levels in a plurality of flights in several separators.

It is another object of the invention to enable efficient use of washing liquid.

It is an additional object of the invention to increase efficiency of separation in a spiral separator.

Still, it is another object of the invention to provide remote control of washing liquid delivered to outlets of a spiral.

Yet, it is another object of the invention to provide automatic control of washing liquid delivered to outlets of a spiral.

BRIEF SUMMARY OF THE INVENTION

The invention relates to a washing liquid distribution system to a variety of surfaces. Preferably, the system is used with spiral separators. The system includes a distributor housing which receives fluid therein to be distributed, a plurality of spaced members have a respective generally vertical passage communicating with fluid in the housing for permitting fluid to flow through the passages into the members, and a plurality of fluid passageways respectively communicating with the members to provide the same or differing amounts of liquid to each of the flights of the spiral.

In one embodiment, the members include a plurality of spaced fluid passageways disposed vertically inside the housing and having a height less than that of the housing. The fluid passageways have respective passage for receiving liquid from the housing into the fluid passageways. The system includes means for tilting the housing to vary liquid flow through the passages, thereby changing amounts of liquid flowing to the plurality of flights in the separator.

In another embodiment, a water or liquid flow distributor housing is disposed on top of an upper inlet of a spiral separator having a helical trough surface shaped into a plurality of flights. The housing includes a liquid flow controller which is a rectangular housing comprised of rectangular sections disposed about a center chamber fluidly connected to a liquid source. Each of the sections has a generally vertical extending passage communicating fluidly with the center chamber. Also, each section has at least one outlet connected to at least one fluid passageway to distribute varying amount of washing liquid passing through the passage to the trough surface. The fluid passageway delivers liquid adjacent an inner side of the trough. The housing may be supported on a pivotal axle midway of the housing or on a hinge joint underneath one side and a rotatable elliptical cam underneath the other side. When the housing is at flat level, a portion of each of the passages is exposed to liquid coming from the chamber and flow into the trough. When the cam rotates upwardly, one side of the housing moves upwardly, while the other side remains coupled to the hinge joint. As a result, the passages are tilted with perhaps some being fully exposed to the liquid flowing from the chamber, others will be less exposed, and some will be completely closed depending on the angle of tilting. Consequently, the amount of liquid flowing through the outlet of each passage will vary in proportion to the angle of tilting. Each passage distributes washing liquid adjacent an inner side of the trough surface. Varying the tilt angle produces proportional changes in the amount of washing liquid flowing in each trough surface of a flight. An operator can change the amount of liquid flowing into a particular flight. By changing the angle of tilt, the amount of liquid flowing through one passage to one flight varies, while the amount flowing from other passages to other flights varies in proportion to the change in the first one.

If a large number of separators are needed, a liquid flow distributor may be disposed on top of each separator. A main liquid supply provides liquid to all the distributors. This scheme enables an operator to control a liquid flow into each separator. Alternatively, one liquid flow distributor can be used for all the separators. Both of those systems can be automated by adding a flow control mechanism to control flow from the liquid supply to a liquid distributor. Preferably, an on-stream analyzer is used to analyze composition of different samples of concentrate middlings and tailings drawn from the spirals. The analyzer signals analysis data to the control mechanism assisting the control mechanism in determining an appropriate amount of flow to the spirals.

In further embodiment, a washing liquid distributor housing has a plurality of compartments disposed around a cylindrical center chamber. A cylindrical liquid flow controller has an upper slanted edge. The liquid flow controller is disposed inside the center chamber with the outer surface of controller being juxtaposed with the inner surface of chamber. Each of the compartments has a vertical passage fluidly connecting the compartment to the center chamber. Also, each compartment has at least one outlet connected to at least one fluid passageway. The liquid flow controller receives liquid from a liquid supply. At any rotated position, the controller exposes and covers some areas or portions of passages to liquid flow. When the controller rotates to selected positions around its vertical central axis inside the center chamber, changes in the areas covered and exposed to liquid flow are provided which changes amount of water flowing through these passages to the fluid passageways. Each passage in each compartment delivers liquid flow to fluid passageways, which are connected to different flights of a separator. Fluid passageways deliver washing liquid to a trough surface of the spiral separator. Consequently, rotation of the controller provides differing amounts of washing liquid to different flights in the separator. If an operator desires to increase or decrease the amount of washing liquid flowing into a separator, the operator simply rotates the controller to cause delivery of more or less amount of liquid. The amount of washing liquid flowing into other flights also will change but the changes will generally be in proportion to the change in flow desired by the operator. The controller upper edge may have different contours as may be required by different processes for separating different particles.

BRIEF DESCRIPTION OF THE SEVERAL VIEWS OF THE DRAWING

The novel features believed to be characteristic of this invention are set forth with particularity in the appended claims. The invention itself however, both as to its organization and method of operation, together with further objects and advantages thereof may best be understood by reference to the following description taken in connection with the accompanying drawings in which:

FIG. 4 is an exploded isometric view of one embodiment of a washing liquid system of this invention;

FIG. 5 is an isometric view of an alternate embodiment showing another disposition of fluid passageways delivering washing liquid adjacent an inner side of a process trough;

DETAILED DESCRIPTION OF THE INVENTION

The features and design details of the invention are best understood by reference to the attached drawings.

Figure 1:
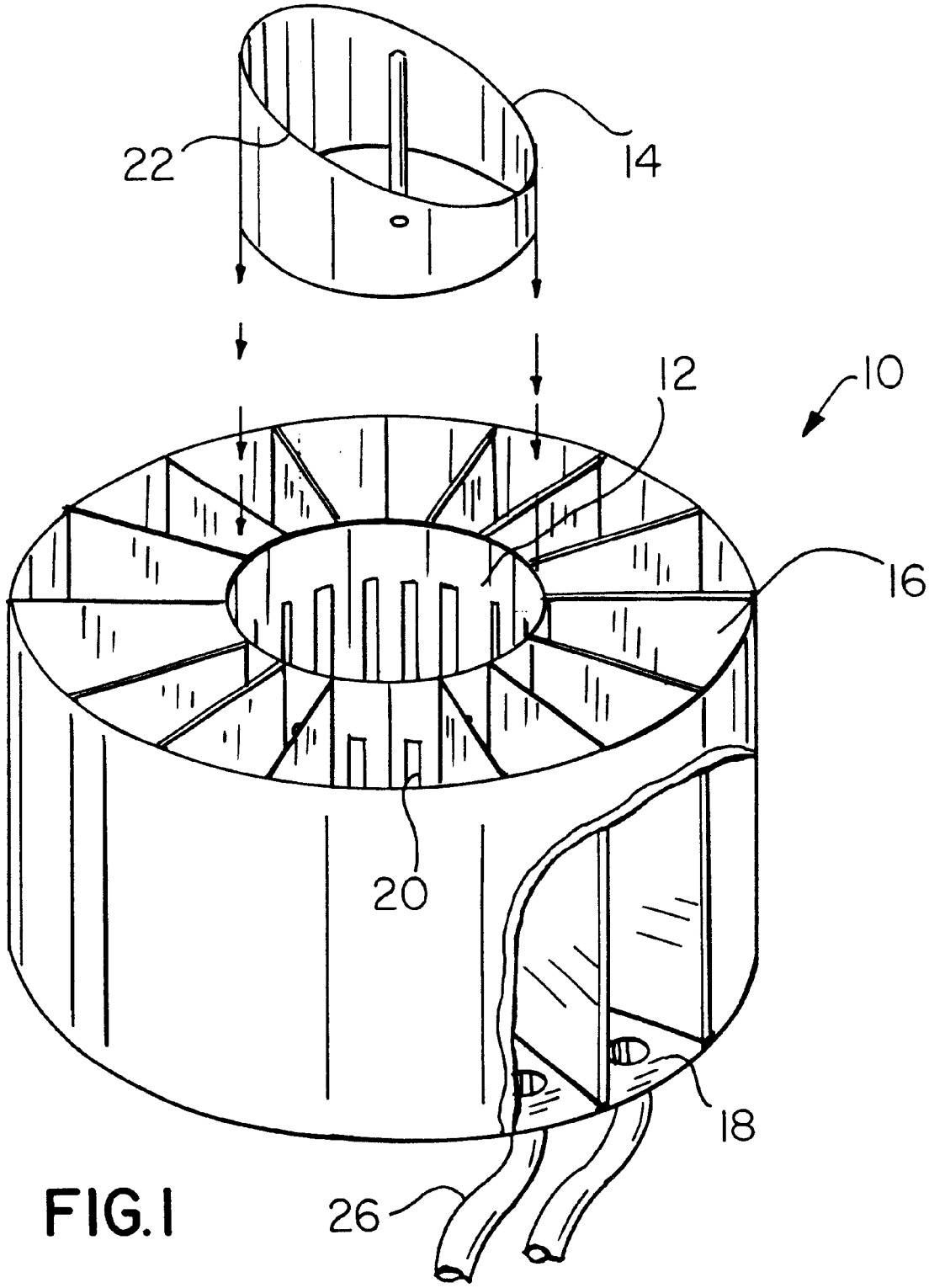
FIG. 1 is an isometric view of one embodiment of a round washing liquid flow distributor with liquid flow controller in accord with this invention.

FIG. 1 shows a washing liquid distributor housing 10 having a plurality of members or compartments 16 disposed around a cylindrical center chamber 12. A cylindrical liquid flow controller 14 is depicted having an upper slanted edge 22. The liquid flow controller 14 is disposed inside the center chamber 12 with the outer surface of controller 14 being juxtaposed with the inner surface of chamber 12. Each of the compartments 16 has a vertical passage 20 fluidly connecting compartment 16 to the center chamber 12. Also, each compartment 16 has at least one outlet 18 connected to at least one fluid passageway or pipe 26. The center chamber 12 with the liquid flow controller 14 receives liquid from a liquid supply, not shown. At any rotated position, the controller 14 exposes and covers some areas or portions of passages 20 to liquid flow. When the controller 14 rotates to selected positions around its vertical central axis inside center chamber 2, changes in the areas covered and exposed to liquid flow are provided which changes amount of water flowing through these passages 20 to fluid passageways 26. Each passage 20 in each compartment 16 delivers liquid flow to fluid passageways 26, which are connected to different flights 30 of a separator 25. Fluid passageways 26 deliver washing liquid to a trough surface 33 of the spiral separator 25. Consequently, rotation of the controller 14 provides differing amounts of washing liquid to different flights 30 in the separator 25, as shown in FIG. 4. If an operator desires to increase or decrease the amount of washing liquid flowing into a trough surface 33, the operator simply rotates the controller 14 to cause delivery of more or less amount of liquid. The amount of washing liquid flowing into other flights also will change but the changes will generally be in proportion to the change in flow desired by the operator. The slanted edge 22 can be provided with different contours having differing properties for various separators which process different particulates.

Figure 2:
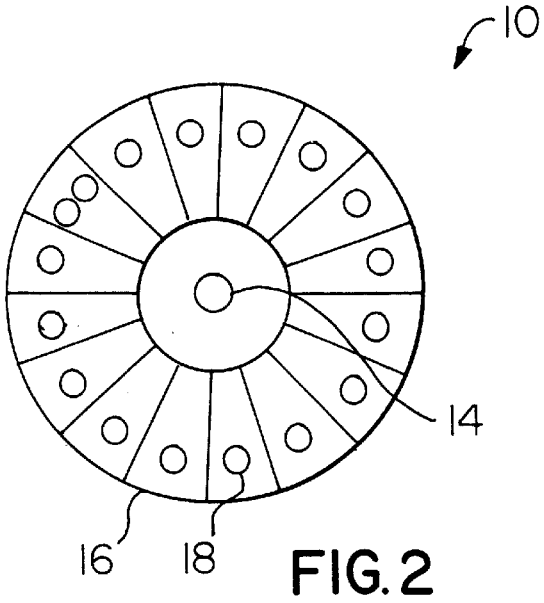
FIG. 2 is a plan view of FIG. 1.

FIG. 2 shows a plan view of an embodiment of the washing liquid distributor 10. The distributor 10 can be of any shape but is shown here as a cylindrical configuration. A plurality of compartments 16 may be of any number and have one or more outlets 18, best shown in FIG. 1.

Figure 3:
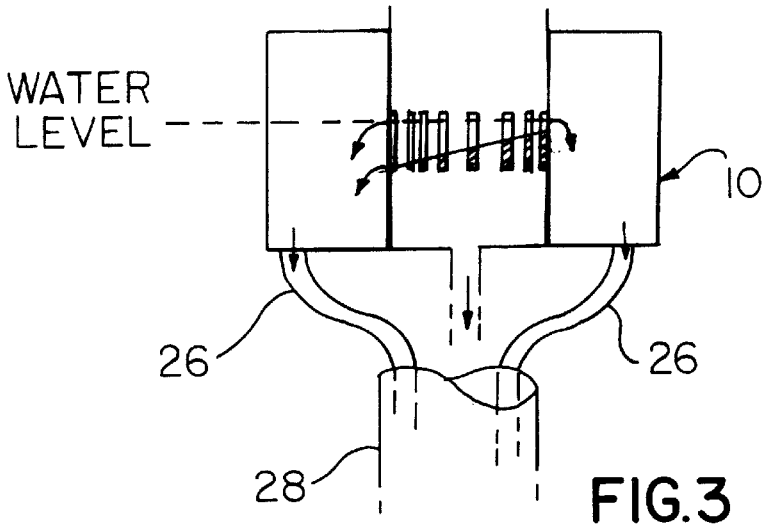
FIG. 3 is a cross sectional view of FIG. 1 and showing the upper end of the supporting column and fluid passages.

FIG. 3 shows a cross section of a liquid distributor housing 10 disposed on top of a single spiral separator 25. A plurality of fluid passageways or liquid carrying fluid passageways 26 extends into a support column 28 of a spiral separator 25. The fluid passageways 26 pass through openings 27 in support column 28 to deliver washing liquid into dampening receivers 32 and 40 to reduce or dampen speed and kinetic energy of the liquid being fed from distributor 10, as shown more clearly in FIGS. 4–6. Receiver 32 laterally discharges washing liquid through bottom opening 32A into trough surface 33 adjacent an inner side of a liquid and concentrate channel 34 to assist in moving heavier concentrating particles flowing adjacent the inner side thereof to their drawoff entrances 35 spaced along the inner side. An adjustable rib 36 pivotally attached at 37 is positioned adjacent channel 34 and serves to divert heavier concentrating particles and water into concentrate channel 34.

An alternative embodiment is shown in FIG. 5 wherein one fluid passageway 26 transports washing liquid from compartment 16, best shown in FIG. 1, to dampening receiver 32 and hence into receiver 40 as well. The fluid passageway 26 delivers washing liquid into receiver 32 and a portion of the liquid therefrom passes through the tube 26A into another receiver 40 spaced downwardly from receiver 32. This arrangement accomplishes an appropriate distribution of the washing liquid by dividing the volume of the liquid between two or more receivers 32 and 40 as may be required when the number of fluid passageways required coining down the support column exceeds the cross-section of the support column.

Figure 6:
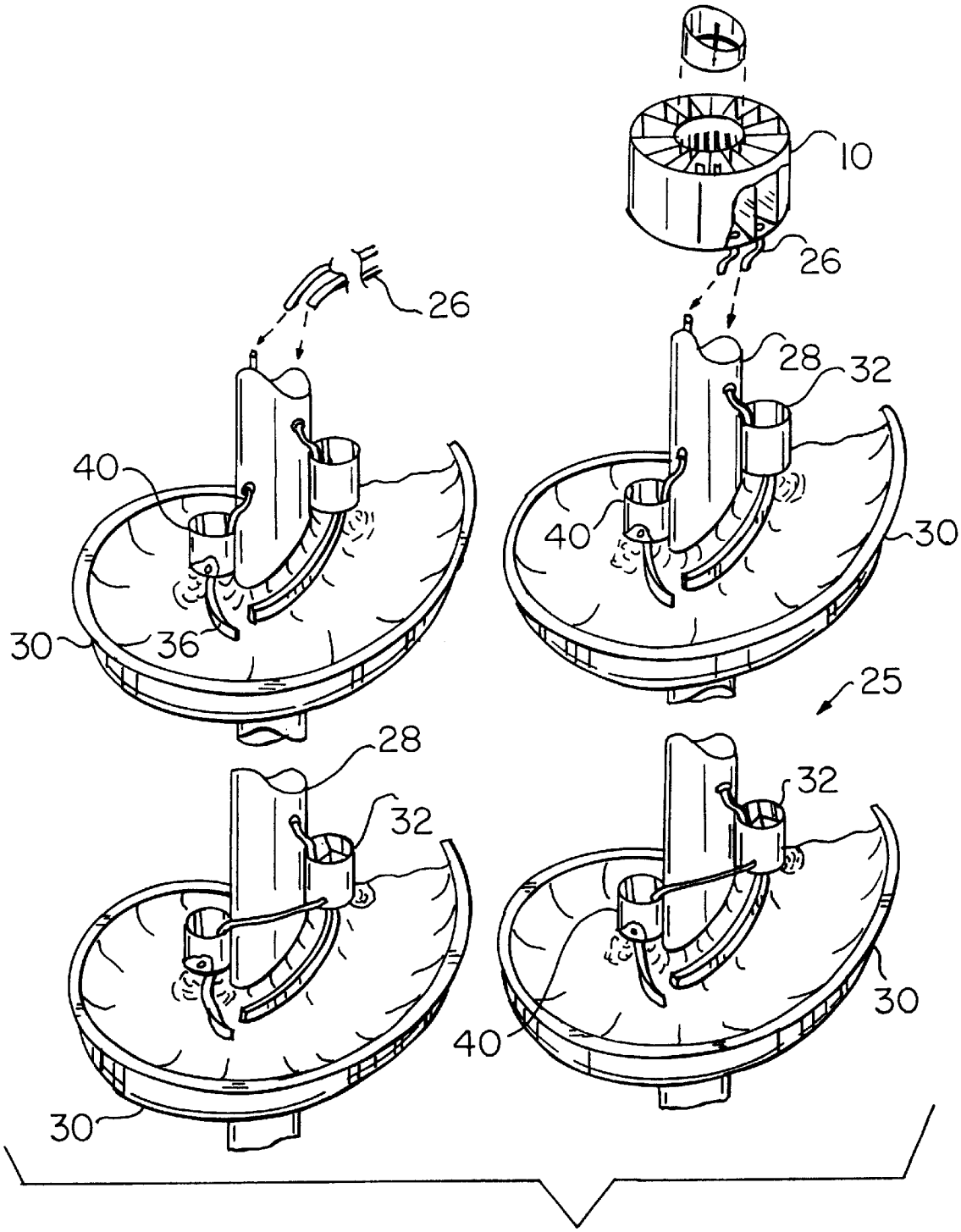
FIG. 6 is an isometric view of a second embodiment of the system showing a single washing liquid distributor delivering washing liquid to a plurality of spiral separators shown separately but may be installed on the same column.

In FIG. 6 there is shown an alternative embodiment. A single liquid distributor 10 distributes washing liquid to a plurality of spiral separators 25 shown separately but may be installed on the same column 28. Each of compartments 16 has double outlets 18 transferring washing liquid to two fluid passageways 26 to deliver the liquid to at least two trough surfaces 33 of spiral separators 25. A plurality of outlets for a plurality of fluid passageways can be employed here. An operator can control and manipulate flow of washing liquid into several separators by employing a single liquid distributor and liquid flow controller as shown here in.

Figure 7:
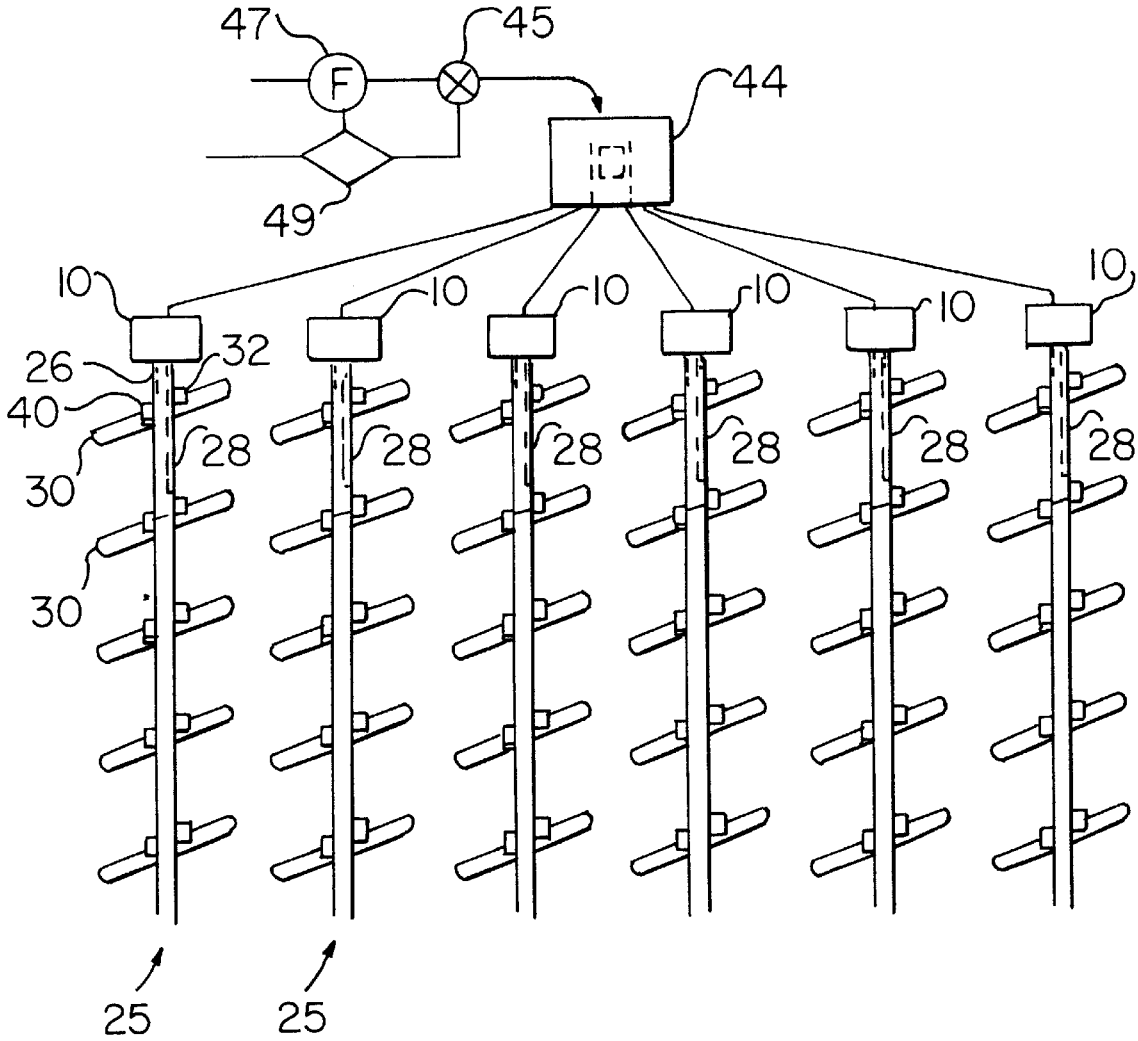
FIG 7 is a cross sectional view showing another embodiment of the system for a main water distribution system.

FIG. 7 shows another alternative system embodiment. A main conventional liquid supply distributor 44 feeds washing liquid to a plurality of secondary distributors 10 at each of columns 28 of separators 25. An operator adjusts liquid flow to a plurality of separators 25 by simply manipulating control valve 45 via electrical valve 49 and flowmeter 47. This arrangement enables the operator to vary the flow of liquid to several separators 25 using a single valve 45 and to control the liquid flow for each separator 25 by its own distributor 10. The above arrangement can be automated to provide efficient and precise control of flow of washing liquid into several separators.

Figure 8:
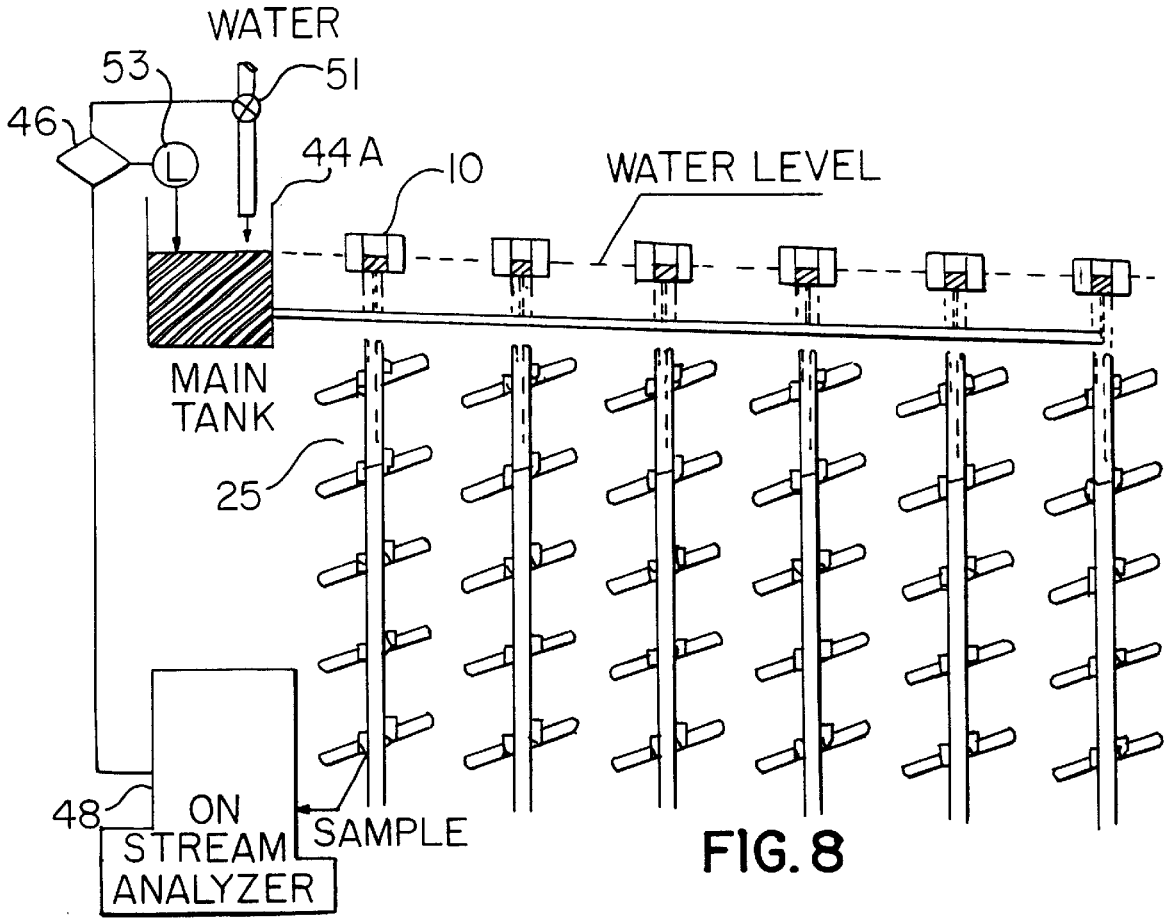
FIG. 8 is a cross section view of a further embodiment showing an automated washing liquid distribution system.

FIG. 8 illustrates another system embodiment wherein a liquid supply tank 44A is connected to a flow control mechanism 46, which includes level sensor 53, water control valve 51 and on-stream analyzer 48. The on-stream analyzer 48 takes samples of the products at pre-determined times and analyzes composition of each sample. The analyzer 48 sends the analysis data to the control mechanism 46 that uses the data determine the amount of washing liquid necessary for the flight 30 in the separators 25 to ensure optimal separation of heavier concentrating particles from lighter particles. The control mechanism 46 manipulates water control valve 51 to adjust the height of liquid in tank 44A and the amount of washing liquid flowing therefrom, thereby adjusting the height of the liquid in each distributor 10.

Figure 9:
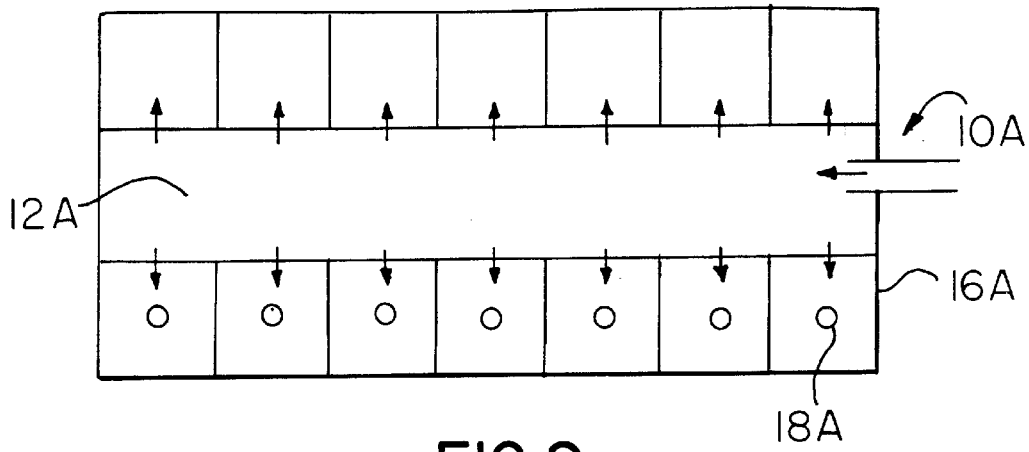
FIG. 9 is a plan view of a rectangular embodiment of a washing liquid distributor.
Figure 10:
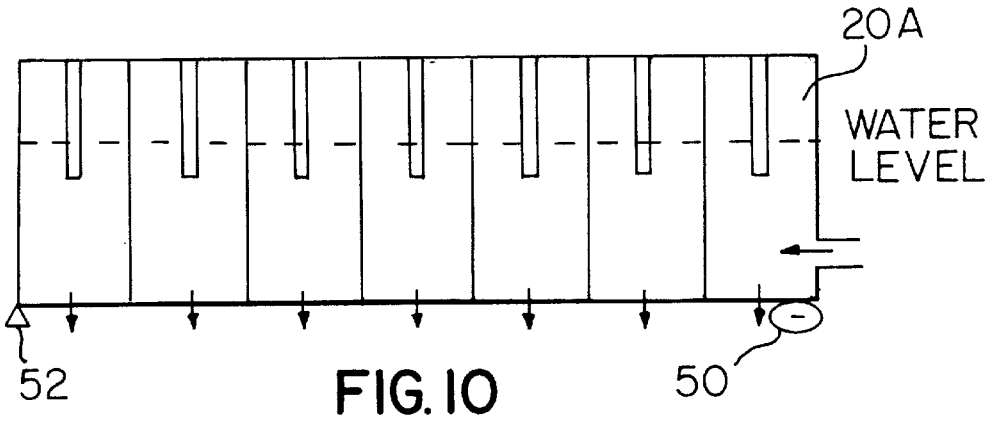
FIG. 10 is a cross sectional view of FIG. 9 with a rotatable cam below one end.
Figure 11:
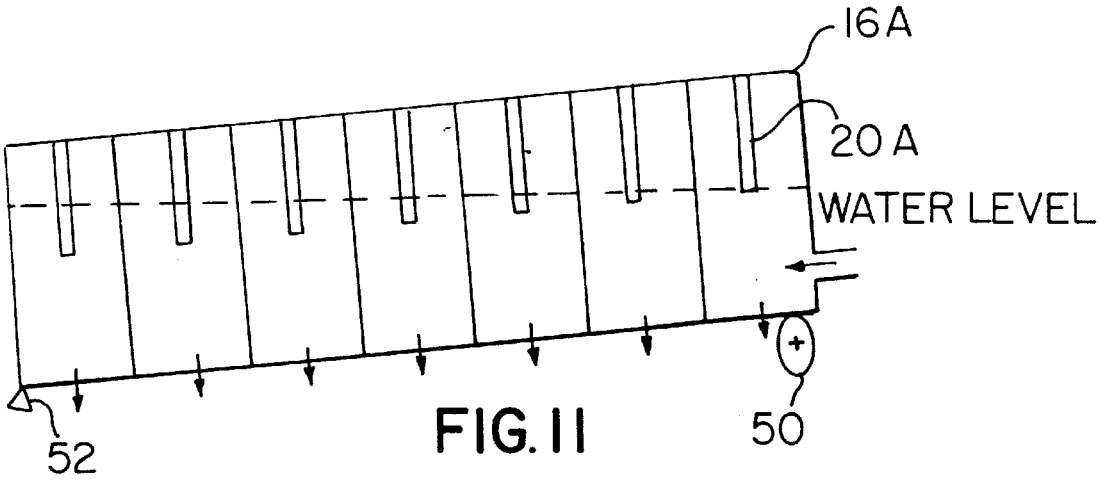
FIG. 11 is a cross sectional view similar to FIG. 10 showing the cam in full tilt position.

An alternative embodiment to washing liquid distributor 10 is shown by 10A in FIG. 9. The distributor housing 10A has a rectangular or oblong shape and includes a plurality of compartments 16A disposed on either side of a center chamber 12A. Each compartment 16A has at least one outlet 18A for transferring washing liquid from the compartment to a trough surface 33, see FIG. 4, of a separator 25 through fluid passageways carrying liquid 26A. Longitudinal cross sectional view of the distributor 10A are shown in FIGS. 10 and 11. Each compartment 16A has a longitudinal passage 20A communicating fluidly with the center chamber 12A. A rotatable elliptical cam 50 in the form of an elongated roll is placed under one end of distributor 10A, while the other side being supported on hinge joint 52. The distributor 10A is at flat level when cam 50 is horizontal or when its rotational angle is at zero. A certain area or portion of each passage 20A is exposed to washing liquid being supplied to the center chamber 12A. When cam 50 rotates preferably between angles zero to ninety, each passage 20A has a different area being exposed to permit more or less washing liquid to flow. As a result, different volumes of liquid flow through each passage 20A through outlets and into each trough surface 33 of a flight 30. The different amounts are in proportion to the angle of rotation of cam 50. An operator establishes the preferred amount of washing liquid for each flight 30 and the proportionate angles of rotation of the cam 50. An operator can increase or decrease the amount of water flowing into each flight without excessively increasing or decreasing the amount needed in other flights. The operator can simply rotate the cam a certain degree to attain a certain flow level entering one flight 30 and a proportional flow in the other flights. This action increases the efficiency of separating heavy from lighter particles by delivering precise amounts of liquid where it is needed into any appropriate flights. It also conserves washing liquid supplied to the separator because only needed quantities will be used. Also efficient operation of a large numbers of spirals each having a plurality of flights is achieved. A synchronized movement of all the cams for the distributor 10A can be achieved by use of a stepping motor to power the cam and such motors may be remotely controlled, as well known in the art.

Figure 12:
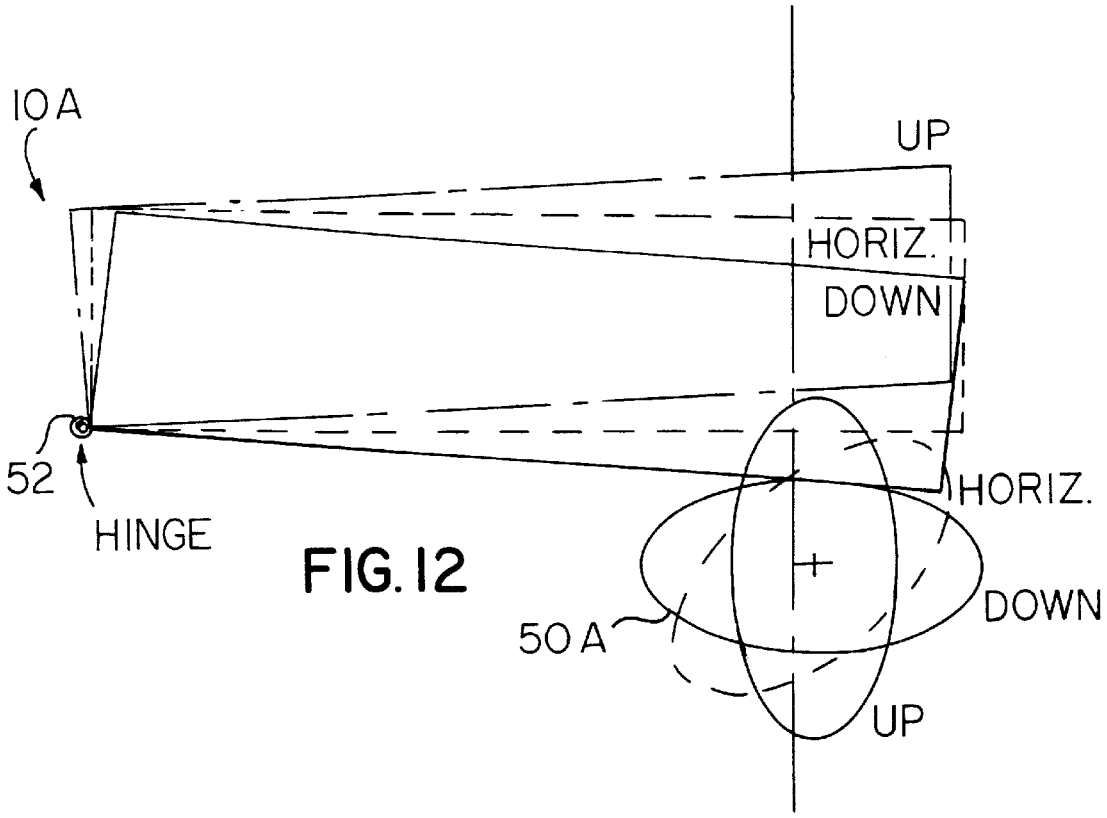
FIG. 12 is a pictorial depiction of another rectangular embodiment of a washing liquid distributor.

FIG. 12 illustrates a further embodiment for rotating cam 50A. Distributor 10A is at a flat level when cam 50A is at approximately 45 degrees angle. When cam 50A rotates 45 degrees downwardly or negative 45 angle degrees, distributor 10A is tilted downwardly. This tilting action changes exposure areas of passages 20A to washing liquid flow, thereby varying the amount of flow to each trough surface 33 of a flight 30. When cam 50A rotates upwardly, distributor 10A tilts upwardly, thus varying flow through each passage 20A to their corresponding trough surface 33 of a flight 30. Other alternative devices for tilting distributor 10A, known to those skilled in the art can also be used, such as lifting devices, screws, wedges, hydraulic cylinders, pistons and motors, and so forth.

Figure 13:
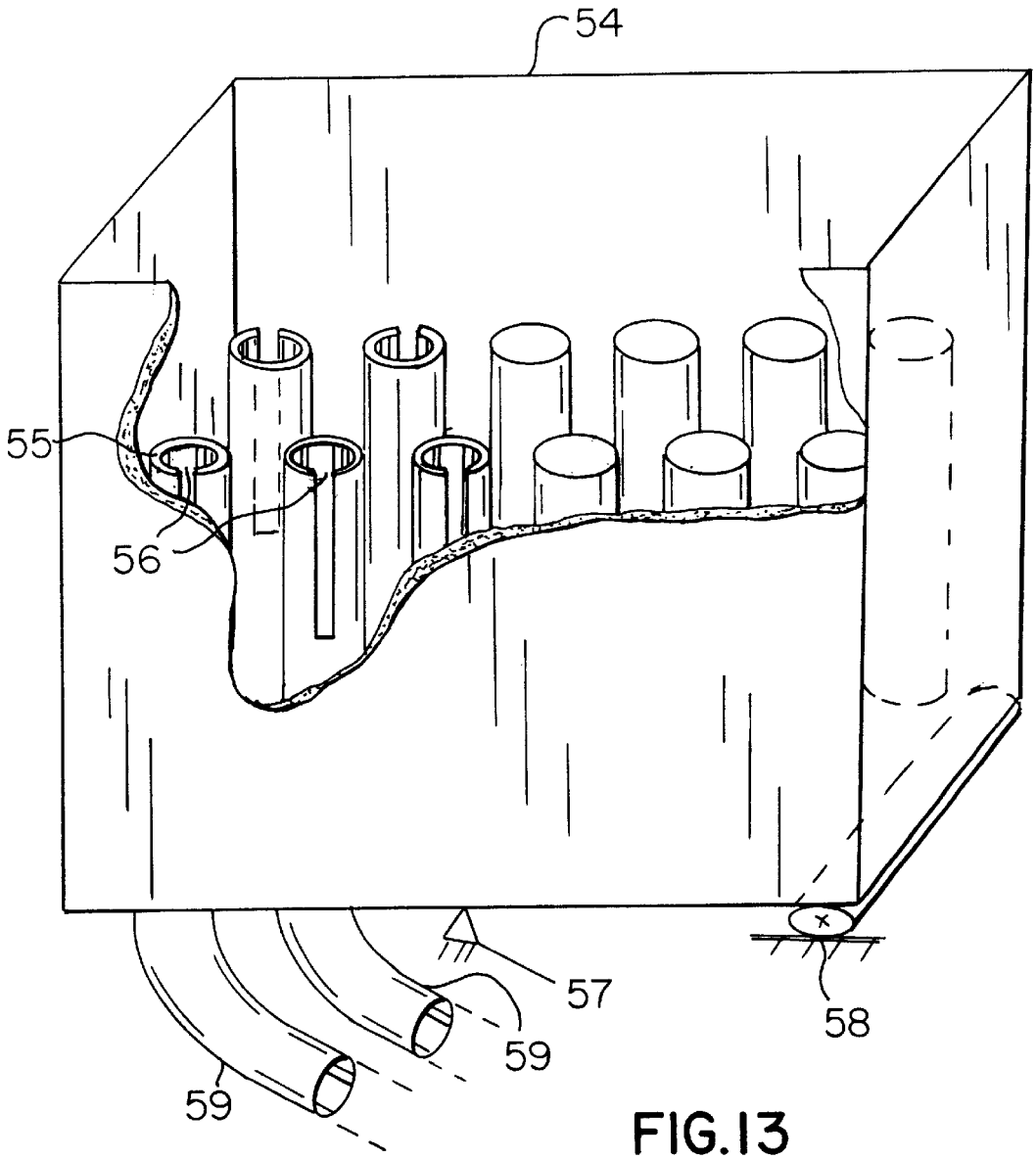
FIG. 13 is an exploded isometric view showing a further embodiment of a washing liquid system having a plurality of fluid passageways having passages disposed in a housing and supported on a pivotal axle midway of the housing and/or a rotatable elliptical cam underneath the other side.

FIG. 13 shows an alternative embodiment of the washing liquid distribution system. A housing 54 contains a plurality of members or fluid passageways 55 disposed inside the housing 54 and each have a generally vertical passage 56 for receiving liquid from the housing 54 into the fluid passageways 55 for delivering the liquid to flights of a spiral separator, shown in FIGS. 4–8. The fluid passageways 55 have a height less than that of the housing 10. In contrast to the embodiment of FIG. 1 where liquid flows through passages 20 in compartments 16 into passageways 26, liquid may flow directly from housing 54 into passages 56 of fluid passageways 55, as shown in FIG. 13. Fluid passageways 55 may or may not be the same fluid passageways 59, which extend through the column 28 of the separator shown in FIGS. 3 and 4. The housing 54 may be supported on a direct powered pivotal axle 57 midway of the housing 54 or on a combination of a non-powered pivotal axle 57 midway and tilting means such as a rotatable elliptical cam 58 underneath one end of the housing 54, as shown in FIGS. 10–12. Rotating the elliptical cam 58 or the powered pivotal axle 57 slants the housing 54, thereby changing water level flowing into passages 56 of fluid passageways 55 and thence delivering differing amounts of liquid to different flights of the spiral separator.

FIG, 13A depicts a generally vertical passage 56A that can be applied if desired to the embodiments shown in FIGS. 1 and 9–12. The V-shaped passage 56A is formed in the upper end of the passageway 55 and is tapered from the top to the bottom including an angle (X) of about 15 to 30 degrees. The passage 56A is tapered to provide greater flow of washing liquid in the upper portion of the passageway 55 thus rendering the tilt adjustment more readily controllable for flow control to the spiral.

Figures 13A, 13B, 13C:
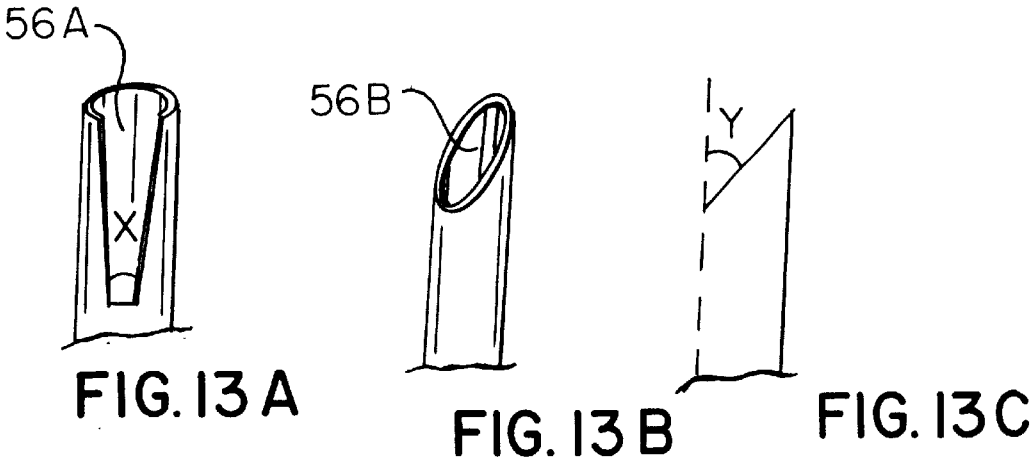
FIGS. 13A and B are practical alternative embodiments of the passages, which can be applied to the embodiments shown in FIGS. 1 and 9–12.
FIG. 13C is a side view of FIG. 13B.

FIG. 13B shows a generally vertical elliptically passage 56B formed at the end of the passageway 55 and can be applied to the embodiments shown in FIG. 13. Also, it is clear that a generally vertical elliptical passage may also be applied if desired to the embodiments of FIGS. 1 and 9–12. On one hand, controlling the amount of water flowing from passage 56B may be more difficult compared to passage 56A; on the other hand, passage 56B may be easier to manufacture on a commercial basis. Other shapes of generally vertical passages or passages having an elongated axis extending generally vertically may also be used without departing from this invention.

While the invention has described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A washing liquid distribution system for distributing liquid to a plurality of flights of a separator comprising a liquid flow distributor including a housing which receives fluid therein to be distributed, a plurality of spaced members having a respective generally vertical passages communicating with fluid in said housing for permitting fluid to flow through said passages into said members, a plurality of fluid passageways respectively communicating with said members to provide the same or differing amounts of liquid to each of said flights.

2. The system of claim 1 wherein said housing includes a central liquid receiving chamber, and wherein said members include a plurality of spaced compartments located in proximity with said chamber and said plurality of generally vertical passages communicate fluidly between said chamber and said compartments, said plurality of passageways including a plurality of pipes respectively coupled to said compartments, each of said compartments delivering the same or differing amounts of liquid to each of said pipes.

3. The system of claim 2 wherein said housing includes a movable flow controller disposed inside said chamber to vary liquid flow to each of said compartments when said flow controller moves from one position to another.

4. The system of claim 3 wherein said controller having a slanted upper edge and having cylindrical shape substantially conforming to said chamber, said chamber being rotatable therein to expose different portions of said passages at every rotation thereby varying the liquid flow to each of said compartments.

5. The system of claim 1 wherein said passages are substantially vertical, and further including a tilting means for slanting said distributor from horizontal to vary exposed areas of said passages thereby varying the amount of liquid flowing into said compartments.

6. The system of claim 1 wherein said housing is elongated, and further including a rotatable cam disposed underneath one end of said housing and a hinge joint disposed underneath another end of said housing, said cam being rotatable for changing slope of said housing to change exposed areas of said passages to liquid in said chamber thereby varying amounts of liquid flowing through said passages into said compartments.

7. The system of claim 1 further including a liquid supply providing liquid to said housing, a control mechanism for controlling flow of liquid flowing inside said members, and a stream analyzer for analyzing composition of a stream of particles traveling through a spiral separator.

8. The system of claim 1 wherein said plurality of fluid passageways being disposed about a support column and pass through openings in the support column to deliver a washing liquid therefrom, said system further including a dampening receiver disposed about the support column and adapted to receive washing liquid from said plurality of fluid passageways to dampen energy of the liquid and deliver the liquid adjacent an inner side of a flight in a spiral separator.

9. The system of claim 8 further including a plurality of dampening receivers disposed directly opposite from each other about the support column.

10. The system of claim 1 wherein said members include a plurality of spaced pipes disposed vertically inside said housing and having a height less than that of said housing, said pipes having respective passages for receiving liquid from said housing into said pipe, and said system further including means for tilting said housing to vary liquid flow through said passages thereby changing amounts of liquid flowing to said plurality of flights.

11. The system of claim 1 wherein said passages are elongated.

12. The system of claim 1 wherein said passages are elliptical.

13. The system of claim 1 wherein said passages are V-shaped narrowing toward a bottom of said housing.

14. A washing liquid distribution system comprising a distributor housing, a central chamber, a plurality of compartments located in proximity with said chamber and having a plurality of passages having an elongated axis extending generally vertically communicating fluidly with said chamber, a plurality of fluid passageways respectively coupled to said compartments, means for simultaneously varying flow of liquid to each of said fluid passages for delivering the same or differing amounts of liquid to each of said fluid passageways.

15. The system of claim 14 wherein said means include a hinge joint disposed underneath one end of said distributor and a tilting member disposed underneath another end of said distributor for tilting said distributor and to vary exposed areas of said passages to liquid thereby varying amounts of liquid flowing to each of said fluid passageways.

16. The system of claim 14 wherein said means include an elongated cam disposed underneath one end of said distributor, a hinge joint disposed underneath another end of said distributor, said cam being rotatable from one position to another to vary exposed areas of said passages to liquid in said chamber thereby varying amounts of liquid flowing to each of said fluid passageways.

17. The system of claim 14 further including a liquid supply providing liquid to said distributor, a control mechanism for controlling flow to said fluid passageways, a stream analyzer for analyzing a composition of a stream of particles traveling through a spiral separator.

18. The system of claim 14 wherein said plurality of fluid passageways being disposed within a support column and pass though openings in said support column to deliver washing liquid therefrom, said system further including dampening receivers spatially disposed about the support column to receive liquid from said plurality of fluid passageways to dampen energy of the liquid and deliver it adjacent an inner side of a trough surface of a flight in a spiral separator.

19. A washing liquid distribution system comprising a distributor having a central chamber, a plurality of hollow members in proximity with said chamber and having a plurality of passages communicating fluidly with said chamber, a plurality of fluid passageways coupled to respective said members, each of said compartments having an outlet communicating fluidly with said fluid passageways, and a flow controller movable from one position to another for exposing different portions of said passages in each of said positions of said controller thereby varying amounts of liquid flowing into each of said members and into each of said fluid passageways.

20. The system of claim 19 wherein said chamber having cylindrical shape, said controller being cylindrical in shape substantially conforming to said chamber and being disposed inside it, said controller having a slanted upper edge exposing different portions of said passages in each of said positions thereby varying amounts of liquid flowing into each of said members.

21. The system of claim 19 wherein said controller includes a tilting member disposed underneath said distributor for tilting said distributor to change exposed areas of said passages thereby varying amounts of liquid flowing to said members.

22. The system of claim 19 wherein said distributor is elongated, said controller including a longitudinal rotatable cam disposed underneath one end of said distributor, a hinge joint disposed underneath another end of said distributor, said cam being rotatable for changing slope of said distributor to change exposed areas of said passages to liquid thereby varying amounts of liquid flowing therefrom.

23. The system of claim 19 further including a plurality of receivers disposed around a support column of a spiral separator to receive washing liquid from said fluid passageways and deliver liquid to a trough surface of a flight in the separator.

24. The system of claim 19 further including a plurality of spiral separators having a plurality of flights, said distributor distributes differing amounts of liquid to each flight of a spiral separator.

25. The system of claim 19 further including a spiral separator for separating heavier particle concentrations from lighter particles and having a plurality of flights, said controller delivers differing amounts of washing liquid to each flight for enhancing efficiency of separation of the separator.

* * * * *